US010349703B2

(12) United States Patent
Bock et al.

(10) Patent No.: US 10,349,703 B2
(45) Date of Patent: Jul. 16, 2019

(54) SHOE, IN PARTICULAR ATHLETIC SHOE

(71) Applicant: PUMA SE, Herzogenaurach (DE)

(72) Inventors: Markus Bock, Herzogenaurach (DE); Randolph Maussner, Spalt (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 15/766,199

(22) PCT Filed: Oct. 7, 2015

(86) PCT No.: PCT/EP2015/001963

§ 371 (c)(1),
(2) Date: Apr. 5, 2018

(87) PCT Pub. No.: WO2017/059876

PCT Pub. Date: Apr. 13, 2017

(65) Prior Publication Data

US 2018/0289110 A1 Oct. 11, 2018

(51) Int. Cl.

| | |
|---|---|
| ***A63B 3/00*** | (2006.01) |
| ***A43C 1/00*** | (2006.01) |
| ***A43C 11/16*** | (2006.01) |
| ***A43C 1/04*** | (2006.01) |
| ***A43B 3/00*** | (2006.01) |

(52) U.S. Cl.

CPC ..... *A43C 11/165* (2013.01); *A43B 3/0005* (2013.01); *A43C 1/00* (2013.01); *A43C 1/04* (2013.01)

(58) Field of Classification Search

CPC ..... A43B 3/0005; A43C 1/00; A43C 1/04; A43C 11/165

See application file for complete search history.

(56) References Cited

U.S. PATENT DOCUMENTS

| | | | | |
|---|---|---|---|---|
| 4,748,726 | A * | 6/1988 | Schoch | A43C 11/16 24/68 B |
| 4,961,544 | A * | 10/1990 | Bidoia | A43B 5/0449 24/68 SK |
| 5,325,613 | A * | 7/1994 | Sussmann | A43C 11/00 24/712.2 |
| 5,557,865 | A | 9/1996 | Sjosvard | |
| 6,202,933 | B1 | 3/2001 | Hammerslag | |

(Continued)

FOREIGN PATENT DOCUMENTS

| | | | |
|---|---|---|---|
| DE | 29817003 | U1 | 3/1999 |
| WO | 2014036374 | A1 | 3/2014 |
| WO | 2014082652 | A1 | 6/2014 |

*Primary Examiner* — Sharon M Prange

(74) *Attorney, Agent, or Firm* — Lucas & Mercanti, LLP

(57) ABSTRACT

An athletic shoe, having a shoe upper and a rotary closure for lacing the shoe on the foot of the wearer by at least one tensioning element. The rotary closure is arranged on the instep of the shoe. The rotary closure has a rotatably arranged tension roller and is driven by an electric motor via a transmission. The transmission includes a first spur gear of the first spur gear stage that meshes with a drive pinion of the electric motor, a pinion, connected to the first spur gear in a rotationally fixed manner, that meshes with a second spur gear of a second spur gear stage, wherein the second spur gear is connected to a worm of a worm gear, and the worm meshes with a worm wheel.

13 Claims, 3 Drawing Sheets

(56) References Cited

U.S. PATENT DOCUMENTS

| | | | | |
|---|---|---|---|---|
| 7,794,101 | B2 * | 9/2010 | Galica | A43B 3/001 36/137 |
| 9,072,341 | B2 | 7/2015 | Jungkind | |
| 9,993,046 | B2 * | 6/2018 | Bock | A43C 11/165 |
| 2003/0150135 | A1 * | 8/2003 | Liu | A43B 3/0005 36/50.1 |
| 2014/0068838 | A1 | 3/2014 | Beers | |
| 2014/0070042 | A1 * | 3/2014 | Beers | A61F 5/028 242/413 |
| 2017/0265579 | A1 * | 9/2017 | Schneider | A43C 11/165 |
| 2018/0125168 | A1 * | 5/2018 | Beers | A43B 3/0005 |
| 2018/0153263 | A1 * | 6/2018 | Beers | A43B 3/0005 |

* cited by examiner

SHOE, IN PARTICULAR ATHLETIC SHOE

CROSS-REFERENCE TO RELATED APPLICATIONS

The present application is a 371 of International application PCT/EP2015/001963, filed Oct. 7, 2015, the priority of this application is hereby claimed and this application is incorporated herein by reference.

BACKGROUND OF THE INVENTION

The invention relates to a shoe, in particular an athletic shoe, having a shoe upper and a rotary closure for lacing the shoe on the foot of the wearer by means of at least one tensioning element, wherein the rotary closure has a rotatably arranged tension roller, wherein the rotary closure is driven by means of an electric motor, and wherein the transfer of the rotational motion of the electric motor to the tension roller occurs via a transmission, wherein the transmission comprises:

- a first spur gear stage, wherein a spur gear of the first spur gear stage meshes with a drive pinion of the electric motor and wherein a pinion, connected to the spur gear of the first spur gear stage in a rotationally fixed manner, meshes with a spur gear of a second spur gear stage,
- a second spur gear stage, wherein the spur gear of the second spur gear stage is connected to a worm of a worm gear in a rotationally fixed manner,
- a worm gear, wherein the worm meshes with a worm wheel, wherein the tension roller is connected to the worm wheel in a rotationally fixed manner.

A shoe of the generic kind is known from WO 2014/036374 A1. A similar shoe is known from DE 298 17 003 U1. Here, a tension roller for winding of a tensioning element is driven via a worm gear so that the shoe can be automatically laced and unlaced. Further solutions are shown in U.S. Pat. No. 6,202,953 B1 and in WO 2014/082652 A1.

It is detrimental at the pre-known solution that the here provided parts must be designed quite big to create the required torque in the tension roller which is necessary for an effective lacing of the shoe.

SUMMARY OF THE INVENTION

It is the object of the invention to design a shoe of the above mentioned kind, especially an athletic shoe, in such a manner that it is ensured at an easy handling of the rotary closure, thus of a central fastener, that a compact design is given which provides sufficient high torques for the lacing. Furthermore, the lacing of the shoe by means of the rotary closure should occur in such a manner that a preferably equal distribution of the tension of the tensioning elements takes place. Thus, the fit of the shoe at the foot of the wearer should be improved.

The solution of this object by the invention is characterized in that the rotary closure is arranged on the instep of the shoe, wherein a first tensioning element is arranged which runs on the lateral side of the shoe upper and wherein a second tensioning element is arranged which runs on the medial side of the shoe upper, wherein both tensioning elements are fixed with their both ends at the tension roller and each form a closed curve at the lateral side or at the medial side of the shoe upper.

The axis of rotation of the tension roller is thereby preferably arranged perpendicular on the surface of the shoe in the region of the instep.

The axis of rotation of the electric motor is preferably arranged horizontally and transversal to the longitudinal extension of the shoe.

The first spur gear stage has preferably a low geared ratio between 1:4 and 1:6. The second spur gear stage has preferably a low geared ratio between 1:3 and 1:5.

The electric motor can be connected with a battery, wherein a limiting element is arranged between battery and electric motor by which the supply current for the electric motor can be limited to a maximum value. By this design it is possible to effect a limitation of the torque at the lacing of the shoe in an easy manner.

The battery, which is preferably a rechargeable battery, can be supplied with a charge current via an induction coil.

Both curves of both tensioning elements at the lateral side and at the medial side of the shoe upper are preferably designed substantially symmetrically to a center plane of the shoe, wherein the center plane is arranged vertical and in longitudinal direction of the shoe.

Specifically preferred is a special guidance of the both tensioning elements at both sides of the shoe upper to obtain an optimal distribution of the lacing tension and so a good fit at the foot of the wearer.

Accordingly, each tensioning element can run from the tension roller to a first deflection element, which deflects the tensioning element in the bottom region of the shoe upper as well as at a location which is arranged in the region between 30% and 42% of the longitudinal extension, measured from the tip of the shoe.

Furthermore, it can be provided that each tensioning element runs from the first deflection element to a second deflection element, which deflects the tensioning element in the bottom region of the shoe upper as well as at a location which is arranged in the region between 50% and 60% of the longitudinal extension, measured from the tip of the shoe.

Furthermore, each tensioning element can run from the second deflection element to a third deflection element, wherein the third deflection element is arranged in the upper region of the shoe upper adjacent to the rotary closure.

Furthermore, each tensioning element can run from the third deflection element to a fourth deflection element, which deflects the tensioning element in the bottom region of the shoe upper as well as at a location which is arranged in the region between 55% and 70% of the longitudinal extension, measured from the tip of the shoe.

Finally, it can be provided that each tensioning element runs from the fourth deflection element to a fifth deflection element, which deflects the tensioning element in a region between 33% and 66% of the total height of the shoe as well as at a location which is arranged in the region between 75% and 90% of the longitudinal extension, measured from the tip of the shoe, wherein the tensioning element runs from the fifth deflection element to the tension roller.

Thereby, the mentioned arrangement of the deflection elements in the bottom region of the shoe upper has to be understood in such a manner that the deflection elements are fixed at the sole of the shoe and a bit above the sole respectively at the shoe upper and thus the deflection location of the tensioning element is arranged in a region of the height which lies below a level of 20% of the vertical extension of the shoe upper (when the shoe is standing on the ground).

Thereby, at least one of the deflection elements can be designed as lug which is fixed, especially sewed, at the shoe upper and/or at the sole of the shoe.

The lugs can thereby consist of a band which is sewed at the shoe upper and/or at the sole of the shoe.

Preferably, the mentioned fifth deflection element encompasses the heel region of the shoe. Thereby, it is preferably provided that the fifth deflection element has a V-shaped design in a side view of the shoe, wherein in the side view of the shoe one of the legs of the V-shaped structure terminates in the upper heel region and the other leg of the V-shaped structure terminates in the bottom heel region.

The tensioning elements are preferably tensioning wires. They can comprise polyamide or consist of this material.

Thus, an important aspect of the present invention is to provide a specifically compact designed gear which allows to be arranged at the instep of the shoe and to operate the rotary closure of the shoe. Thereby, a sufficient big torque is created to realize an effective lacing of the shoe. The proposed gear has a multi-staged design and allows thus to employ an electric motor which creates a relatively low torque, which however operates with a high revolution (for example with a revolution 20,000 min−1).

Above the gear also respective switches for the operation of the rotary fastener can be arranged, for example one switch for the opening and one switch for the closure of the rotary closure. The switches can be designed as press buttons.

The battery can be arranged in a midsole of the shoe. The electronics which are required for recharging of the battery can be located directly at the battery. By providing of an induction coil the battery can be recharged contactless. For doing so the shoe can be placed on a respective loading plate and so the battery can be recharged.

Also, a controlling of the rotary closure can be provided in a wireless manner via Bluetooth by a smart phone which is provided with a respective app.

The rotary closure comprises—as explained above—preferably two separate tensioning wires, one for the lateral region and one for the medial region of the shoe. The effect, which can be obtained thereby, it that at the lacing of the shoe the sole is pulled upward especially in the joint region ("sandwich effect"); likewise the heel is pulled forward. Thereby, the lacing can be improved beneficially.

BRIEF DESCRIPTION OF THE DRAWING

In the drawing an embodiment of the invention is shown.

DETAILED DESCRIPTION OF THE INVENTION

Figure 1:
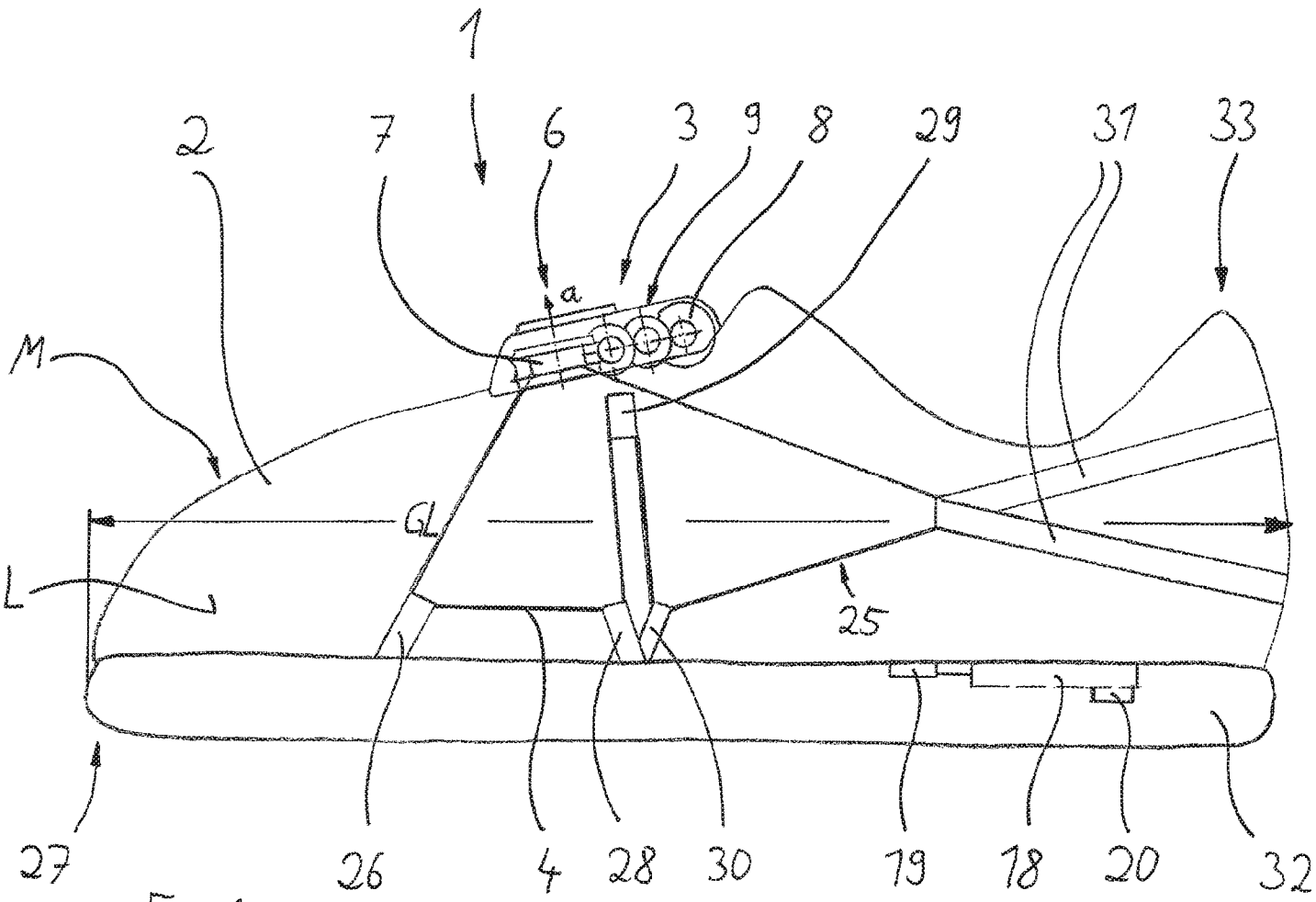
FIG. 1 shows schematically in the side view a sports shoe, which can be laced by means of a rotary closure.

In FIG. 1 a shoe 1 is shown in the form of a sport shoe which comprises a shoe upper 2 and a sole 32. The lateral side L of the shoe 1 and of the shoe upper 2 respectively is shown in the depicted side view; the medial side M of the shoe 1 and of the shoe upper 2 respectively lies at the reverse side of the shoe 1 which cannot be seen (denoted by the reference numeral M).

The lacing of the shoe 1 occurs by means of a rotary closure 3 (i. e. with a central closure), wherein two tensioning elements 4 and 5 are winded by rotating of a tension roller 7 on the tension roller and so the shoe upper 2 is tied at the foot of the wearer of the shoe 1.

The rotary closure 3 is arranged on the instep 6 of the shoe 1. Accordingly, a convenient accessibility to the rotary closure 3 is ensured for the user of the shoe, who must only actuate respective (not depicted) switches for opening and closing of the rotary closure because the rotary closure 3 is operated by an electric motor.

Thereby, the axis of rotation a of the tension roller 7 is perpendicular on the region of the instep 6 of the shoe.

Figure 2:
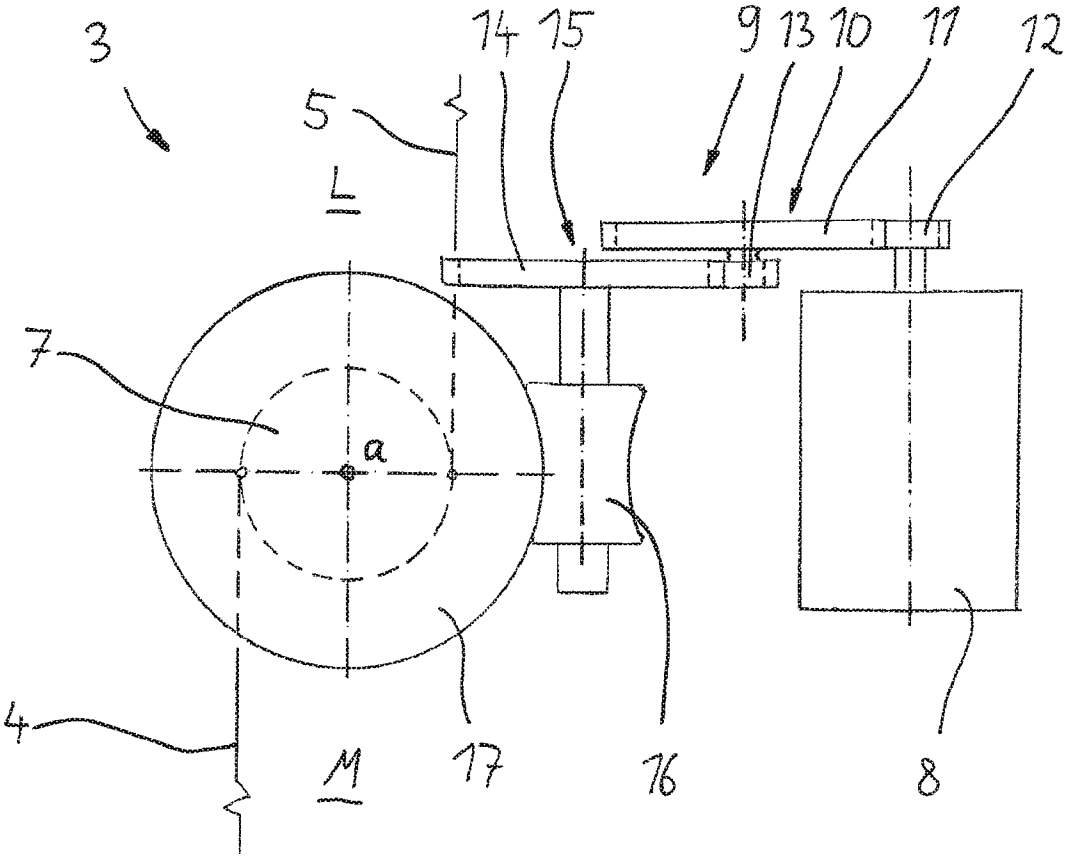
FIG. 2 shows schematically in the top plan view a gear by which a tension roller is driven by an electric motor to tension the tension elements of the rotary closure and FIG. 3 shows schematically the tension roller of the rotary closure with a schematically depiction of the fixation of the ends of the tensioning elements.

For opening and closing of the rotary closure 3 an electric motor 8 is provided which axis of rotation is directed horizontally and transverse to the longitudinal extension of the shoe. The rotational movement of the electric motor 8 is transmitted via a transmission 9 onto the tension roller 7. The substantial components of the transmission are shown in FIG. 2.

Accordingly, the transmission 9 comprises at first a first spur gear stage 10, wherein a spur gear 11 of the first spur gear stage 10 meshes with a drive pinion 12 of the electric motor 8. A pinion 13 which is connected with the spur gear 11 of the first spur gear stage 10 in a rotational fixed manner meshes with a spur gear 14 of a second spur gear stage 15.

The second spur gear stage 15 comprises the spur gear 14 which is connected with a worm 16 of a worm gear 16, 17 in a rotational fixed manner.

The worm 16 of the worm gear 16, 17 meshes with a worm wheel 17, wherein the tension roller 7 is connected with the worm wheel 17 in a rotational fixed manner.

The pinions 12 and 13 respectively have preferably between 10 and 14 teeth. The spur gears 11 and 14 of the first and of the second spur gear stage 10 and 15 respectively have preferably between 50 and 70 teeth.

With regard to FIG. 1 is can be seen that a battery 18 is arranged in the midsole of the shoe 1 which supplies the electric motor 8 with energy. Thereby a limiting element 19 is provided which limits the current to the electric motor 8 and thus takes care for a limitation of the torque which can be transmitted onto the tension roller 7.

An induction coil 20 is provided for charging of the battery 18 by which energy can be transferred into the battery in a wireless manner.

A first tensioning element 4 is provided for the lateral side L of the shoe upper 2 and a second tensioning element 5 for the medial side M of the shoe upper 2.

Figure 3:
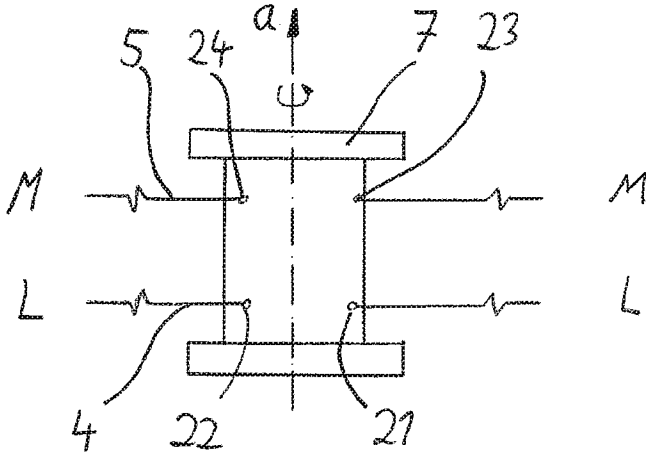

As can be seen from the schematic depiction according to FIG. 3 both ends 21 and 22 of the first tensioning element 4 as well as the two ends 23 and 24 of the second tensioning element 5 are fixed at the winding region of the tension roller 7 so that the section of the tensioning elements 4 and 5 respectively which is effectively available for tying can be shortened by rotating of the tension roller 7 and so the tying of the shoe takes place.

Thus, the closed curve 25 (see FIG. 1) for the first tensioning element 4 for the lateral side L as shown in FIG. 1 contracts at the rotation of the tensioning roller 7 and causes that the shoe upper 2 is drawn to the foot of the wearer of the shoe 1.

As can be seen from FIG. 1 the closed curve 25, i. e. the guiding of the tensioning element 4 on the lateral side L of the shoe upper 2 (the same applies for the medial side M of the shoe upper 2) is specially designed. Therefore, five deflection elements are arranged, namely a first deflection element 26, a second deflection element 28, a third deflection element 29, a fourth deflection element 30 and a fifth deflection element 31.

The first deflection element 26 is thereby arranged in the front region of the shoe, namely at a longitudinal position of the shoe which correlates between 30% and 42% of the total longitudinal extension GL of the shoe, measured from the tip 27 of the shoe. Thereby, the deflection element 26 which is designed as a loop joins substantially in the transition region between the sole 32 and shoe upper 2.

The second deflection element 28 is positioned in such a manner that the tensioning element 4 is guided substantially horizontally from the first deflection element 26 to the rear end (directed to the heel). The longitudinal position of the second deflection element 28 is located at a marking between 50% and 60% of the longitudinal extension GL, again measured from the tip 27 of the shoe.

The tensioning element 4 is guided from the second deflection element 28 upwards in the direction of the rotary closure 3. Below the rotary closure 3 a third deflection element 29 is arranged which deflects the tensioning element 4 substantially by 180° and guides again downwards, namely to a fourth deflection element 30 which is located at a marking between 55% and 70% of the longitudinal extension GL of the shoe.

Finally, the tensioning element 4 is guided from the fourth deflection element 30 to a fifth deflection element 31 which is arranged with respect to its height position at a level between 33% and 66% of the total height of the shoe. With respect to the longitudinal position the fifth deflection element 31 is arranged at a location which lies in a region between 75% and 90% of the longitudinal extension GL, measured from the tip 27 of the shoe. The tensioning element 4 runs then back from the fifth deflection element 31 to the rotary closure 3.

All deflection elements 26, 28, 29, 30 and 31 are designed in the embodiment as bands which are formed to a loop and are fixed at the shoe upper. With respect to the fifth deflection element 31 it can be seen that this runs around the heel region 33 of the shoe 1 and joins at the same respectively.

The two right end regions of the fifth deflection element 31 which can be seen in FIG. 1 start at different height positions of the heel 33, namely at the one hand relatively low near the sole 32 and at the other hand a little amount below of the upper end of the heel 33. Correspondingly, the depicted V-shaped structure results.

The closed curves 25 are designed substantially symmetrical at both sides of the shoe upper 2, namely to a centre plane which is arranged centrally in the shoe 1, which is oriented vertically and which runs in longitudinal direction of the shoe.

By the proposed design the shoe can not only be laced very easy by electromotive rotating of the tension roller 7 by the wearer of the shoe, also the pressure of the tensioning element 4 and 5 is distributed very equally and leads to a homogeneous fit of the shoe 1 at the foot of the wearer.

Thereby, it can be provided that the outermost layer of the shoe upper 2 covers the tensioning element 4 and 5 so that the same are not visible.

LIST OF REFERENCES

1 Shoe
2 Shoe upper
3 Rotary closure
4 First tensioning element
5 Second tensioning element
6 Instep
7 Tension roller
8 Electric motor
9 Transmission
10 First spur gear stage
11 Spur gear of the first spur gear stage
12 Drive pinion of the electric motor
13 Pinion
14 Spur gear of the second spur gear stage
15 Second spur gear stage
16, 17 Worm gear
16 Worm
17 Worm wheel
18 Battery
19 Limiting element
20 Induction coil
21 End of first tensioning element
22 End of first tensioning element
23 End of second tensioning element
24 End of second tensioning element
25 Curve
26 First deflection element
27 Tip of shoe
28 Second deflection element
29 Third deflection element
30 Fourth deflection element
31 Fifth deflection element
32 Sole
33 Heel region
M Medial side of the shoe upper
L Lateral side of the shoe upper
a Axis of rotation of the tension roller
GL Longitudinal extension of the shoe

The invention claimed is:

1. A shoe, having a shoe upper, tensioning elements including a first tensioning element and a second tensioning element, and a rotary closure for lacing the shoe on the foot of the wearer by the tensioning elements, wherein the rotary closure has a rotatably arranged tension roller, wherein the rotary closure is driven by an electric motor, and wherein the transfer of the rotational motion of the electric motor to the tension roller occurs via a transmission, wherein the transmission comprises:

a first spur gear stage, wherein a spur gear of the first spur gear stage meshes with a drive pinion of the electric motor and wherein a pinion is connected to the spur gear of the first spur gear stage in a rotationally fixed manner, a second spur gear stage with a spur gear, wherein the spur gear of the second spur gear stage meshes with the pinion of the first spur gear stage, a worm gear with a worm connected to the spur gear of the second spur gear stage in a rotationally fixed manner, wherein the worm meshes with a worm wheel, wherein the tension roller is connected to the worm wheel in a rotationally fixed manner, wherein the rotary closure is arranged at an instep region of the shoe, wherein the first tensioning element runs on the lateral side of the shoe upper and wherein the second tensioning element runs on the medial side of the shoe upper, wherein each of the tensioning elements has two ends fixed at the tension roller, wherein the first tensioning element forms a closed curve at the lateral side of the shoe upper and wherein the second tensioning element forms a closed curve at the medial side of the shoe upper, and wherein each of the tensioning elements runs from the tension roller to a first deflection element, which deflects the tensioning element in the bottom region of the shoe upper as well as at a location which is arranged in the region between 30% and 42% of a longitudinal extension, measured from the tip of the shoe.

2. The shoe according to claim 1, wherein the axis of rotation of the tension roller is perpendicular to a surface of the shoe in the instep region.

3. The shoe according to claim 1, wherein the axis of rotation of the electric motor is arranged horizontally and transversal to the longitudinal extension of the shoe.

4. The shoe according to claim 1, wherein the first spur gear stage has a low geared ratio between 1:4 and 1:6.

5. The shoe according to claim 1, wherein the second spur gear stage has a low geared ratio between 1:3 and 1:5.

6. The shoe according to claim 1, wherein the electric motor is connected with a battery, wherein a limiting element is arranged between battery and electric motor by which the supply current for the electric motor can be limited to a maximum value.

7. The shoe according to claim 6, wherein the battery being rechargeable can be supplied with a charge current via an induction coil.

8. The shoe according to claim 1, wherein both curves of both tensioning elements at the lateral side and at the medial side of the shoe upper are designed substantially symmetrically to a center plane of the shoe, wherein the center plane is arranged vertical and along the longitudinal extension of the shoe.

9. The shoe according to claim 1, wherein the each of the tensioning elements runs from the first deflection element to a second deflection element which deflects the tensioning element in the bottom region of the shoe upper as well as at a location which is arranged in the region between 50% and 60% of the longitudinal extension, measured from the tip of the shoe.

10. The shoe according to claim 9, wherein the each of the tensioning elements runs from the second deflection element to a third deflection element, wherein the third deflection element is arranged in the upper region of the shoe upper adjacent to the rotary closure.

11. The shoe according to claim 10, wherein the each of the tensioning elements runs from the third deflection element to a fourth deflection element, which deflects the tensioning element in the bottom region of the shoe upper as well as at a location which is arranged in the region between 55% and 70% of the longitudinal extension, measured from the tip of the shoe.

12. The shoe according to claim 11, wherein the each of the tensioning elements runs from the fourth deflection element to a fifth deflection element, which deflects the tensioning element in a region between 33% and 66% of the total height of the shoe as well as at a location which is arranged in the region between 75% and 90% of the longitudinal extension, measured from the tip of the shoe, wherein the each of the tensioning elements runs from the fifth deflection element to the tension roller.

13. A shoe according to claim 1, wherein the shoe is an athletic shoe.

* * * * *